US009861255B2

(12) United States Patent
Kim et al.

(10) Patent No.: US 9,861,255 B2
(45) Date of Patent: Jan. 9, 2018

(54) DISHWASHER AND SENSING MODULE FOR THE SAME

(71) Applicant: SAMSUNG ELECTRONICS CO., LTD., Suwon-si (KR)

(72) Inventors: Hyoung Jum Kim, Uiwang-si (KR); Ji Suk Ryu, Pusan-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 310 days.

(21) Appl. No.: 14/258,628

(22) Filed: Apr. 22, 2014

(65) Prior Publication Data

US 2014/0318585 A1 Oct. 30, 2014

(30) Foreign Application Priority Data

Apr. 25, 2013 (KR) ..... 10-2013-0046132

(51) Int. Cl.
*A47L 15/42* (2006.01)

(52) U.S. Cl.
CPC ..... *A47L 15/4297* (2013.01); *A47L 15/4212* (2013.01); *A47L 15/4214* (2013.01); *A47L 15/4244* (2013.01); *A47L 15/4274* (2013.01); *A47L 15/4287* (2013.01); *A47L 2401/09* (2013.01); *A47L 2401/10* (2013.01); *A47L 2401/12* (2013.01)

(58) Field of Classification Search
CPC ..... A47L 15/4212; A47L 15/4214; A47L 15/4244; A47L 15/4274; A47L 15/4287; A47L 15/4297; A47L 2401/09; A47L 2401/10; A47L 2401/12
USPC ..... 134/56 D, 57 D, 58 D, 113
See application file for complete search history.

(56) References Cited

U.S. PATENT DOCUMENTS

| | | | |
|---|---|---|---|
| 5,446,531 | A | 8/1995 | Boyer et al. |
| 2006/0237036 | A1 | 10/2006 | Picardat et al. |

FOREIGN PATENT DOCUMENTS

| | | | |
|---|---|---|---|
| EP | 1335060 | A1 | 8/2003 |
| EP | 1358833 | A2 | 11/2003 |
| EP | 1677085 | A2 | 7/2006 |
| EP | 2233058 | A1 | 9/2010 |

OTHER PUBLICATIONS

Extended European Search Report dated Feb. 11, 2015 in corresponding European Patent Application No. 14165840.1.

*Primary Examiner* — Levon J Shahinian
(74) *Attorney, Agent, or Firm* — Staas & Halsey LLP

(57) ABSTRACT

A dishwasher including a washing chamber to perform dishwashing, a water collecting portion provided at a lower portion of the washing chamber to gather water used for washing, and a sensing module which is disposed in the water collecting portion and integrally includes a water sensing sensor to sense whether or not water is present and a temperature sensor to sense a temperature of water. Since the sensing module simultaneously serves as the water sensing sensor and the temperature sensor, it may be possible to more efficiently utilize an inner space of the water collecting portion.

21 Claims, 10 Drawing Sheets

DISHWASHER AND SENSING MODULE FOR THE SAME

CROSS-REFERENCE TO RELATED APPLICATIONS

This application claims the benefit of Korean Patent Application No. 2013-0046132, filed on Apr. 25, 2013 in the Korean Intellectual Property Office, the disclosure of which is incorporated herein by reference.

BACKGROUND

1. Field

Embodiments of the present disclosure relate to a sensing module including a water sensing sensor which is disposed in a water collecting portion gathering water to sense the water, and a dishwasher having the same.

2. Description of the Related Art

In general, a dishwasher is an apparatus which sprays water onto dishes placed therein to wash the dishes, and includes a main body provided, at a front surface thereof, with an insert hole through which the dishes are inserted, a washing chamber disposed inside the insert hole, a door to open and close the insert hole, a rack disposed within the washing chamber in order to store the dishes, a nozzle unit spraying water onto the dishes put on the rack to wash contaminants off of the dishes, and the like.

In such a dishwasher, the washing chamber is provided, at a lower portion thereof, with a sump to gather water used for dishwashing so that the water is circulated or discharged, and the sump is provided with a pump to drain or circulate water, a heater to heat water, and the like.

In addition, a variety of sensors are arranged within the sump so as to accurately control operations of the dishwasher by checking water accommodated in the sump. These sensors include a water sensing sensor to sense whether or not water is present in the sump, a temperature sensor to sense a temperature of water, a turbidity sensor to sense turbidity of water accommodated in the sump, and the like.

SUMMARY

Therefore, it is an aspect of the present disclosure to provide a dishwasher having a sensor installation structure capable of more efficiently utilizing an inner space of a sump.

Additional aspects of the disclosure will be set forth in part in the description which follows and, in part, will be obvious from the description, or may be learned by practice of the disclosure.

In accordance with one aspect of the present disclosure, a dishwasher includes a washing chamber to perform dishwashing, a water collecting portion provided at a lower portion of the washing chamber to gather water used for washing, and a sensing module which is disposed in the water collecting portion and integrally includes a water sensing sensor to sense whether or not water is present and a temperature sensor to sense a temperature of water.

The sensing module may be disposed to be spaced apart from a bottom of the water collecting portion.

The sensing module may include a printed circuit board on which the water sensing sensor and the temperature sensor are mounted, and the water sensing sensor may include a capacitive sensor which includes a first electrode disposed on a first surface of the printed circuit board and a second electrode disposed on a second surface of the printed circuit board opposite to the first surface.

The second electrode and the temperature sensor may be disposed side by side at one end of the printed circuit board.

The printed circuit board may include a slit provided between the second electrode and the temperature sensor.

The sensing module may include a sensor housing accommodating the printed circuit board on which the water sensing sensor and the temperature sensor are mounted.

The sensing module may further include a resin filled in an inner portion of the sensor housing to fill a space between the printed circuit board and the inner portion of the sensor housing.

The sensor housing may include a sensing portion protruding inward of the water collecting portion, the printed circuit board being disposed within the sensing portion, and the water collecting portion may include a through hole provided on a side wall thereof, the sensing portion protruding through the through hole.

The sensor housing may include at least one catching portion protruding from an outer peripheral surface thereof, and the through hole may include a sensing portion passing part through which the sensing portion passes, and at least one catching portion passing part formed in a shape corresponding to the at least one catching portion such that the at least one catching portion passes through the at least one catching portion passing part.

The at least one catching portion may include two catching portions formed in different shapes from each other, and the at least one catching portion passing part may include two catching portion passing parts formed in respective shapes corresponding to the two catching portions.

The sensor housing may include a mounting portion formed to have a larger diameter than the through hole, and the water collecting portion may include a seating portion extending from a part adjacent to the through hole to seat and support the mounting portion.

The dishwasher may further include a sealing member to seal between an inner peripheral surface of the seating portion and an outer peripheral surface of the mounting portion.

The water collecting portion may include a pair of stopper portions to limit a rotation angle of the sensing module, and the sensor housing may include a pair of stopper protrusions which are respectively caught by the pair of stopper portions depending on rotation of the sensing module.

The water collecting portion may include a locking portion protruding in order for the sensing module rotating in one direction to limit rotation in a reverse direction, and the sensor housing may include an elastic hook provided to correspond to the locking portion, the elastic hook being elastically deformed as the sensing module rotates in one direction and being caught by the locking portion.

In accordance with another aspect of the present disclosure, a dishwasher includes a washing chamber to perform dishwashing, a water collecting portion provided at a lower portion of the washing chamber to gather water used for washing, and a sensing module disposed in the water collecting portion to sense whether or not water is present, wherein the sensing module includes a printed circuit board and a water sensing sensor mounted on the printed circuit board, and the water sensing sensor includes a capacitive sensor which includes a first electrode disposed on a first surface of the printed circuit board and a second electrode disposed on a second surface of the printed circuit board opposite to the first surface.

In accordance with a further aspect of the present disclosure, a sensing module for a dishwasher includes a capacitive sensor installed in a dishwasher to sense whether or not water is present, wherein the capacitive sensor includes a printed circuit board, a first electrode disposed on a first surface of the printed circuit board, and a second electrode disposed on a second surface of the printed circuit board opposite to the first surface.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
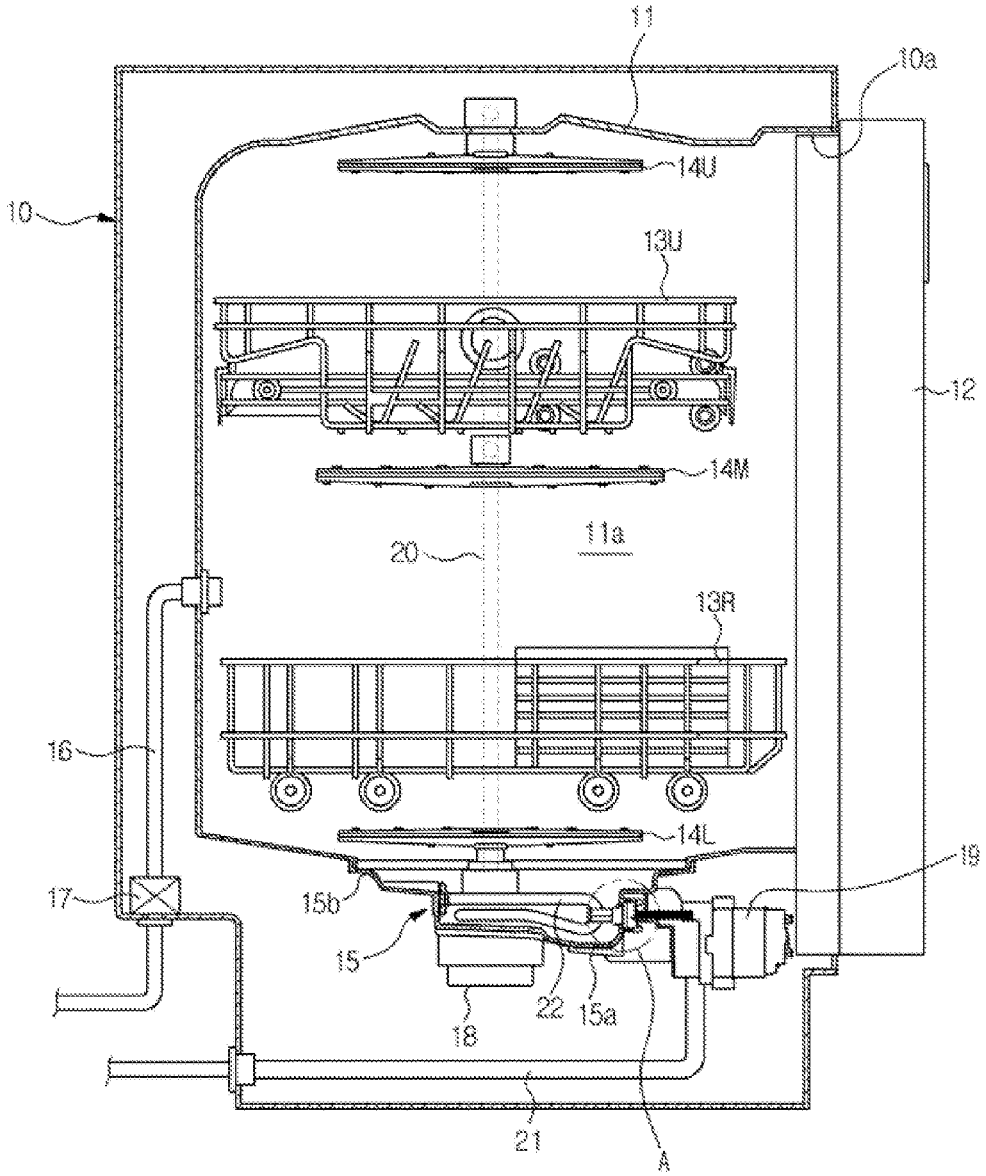
FIG. 1 is a cross-sectional view illustrating a dishwasher according to an embodiment of the present disclosure.
Figure 2:
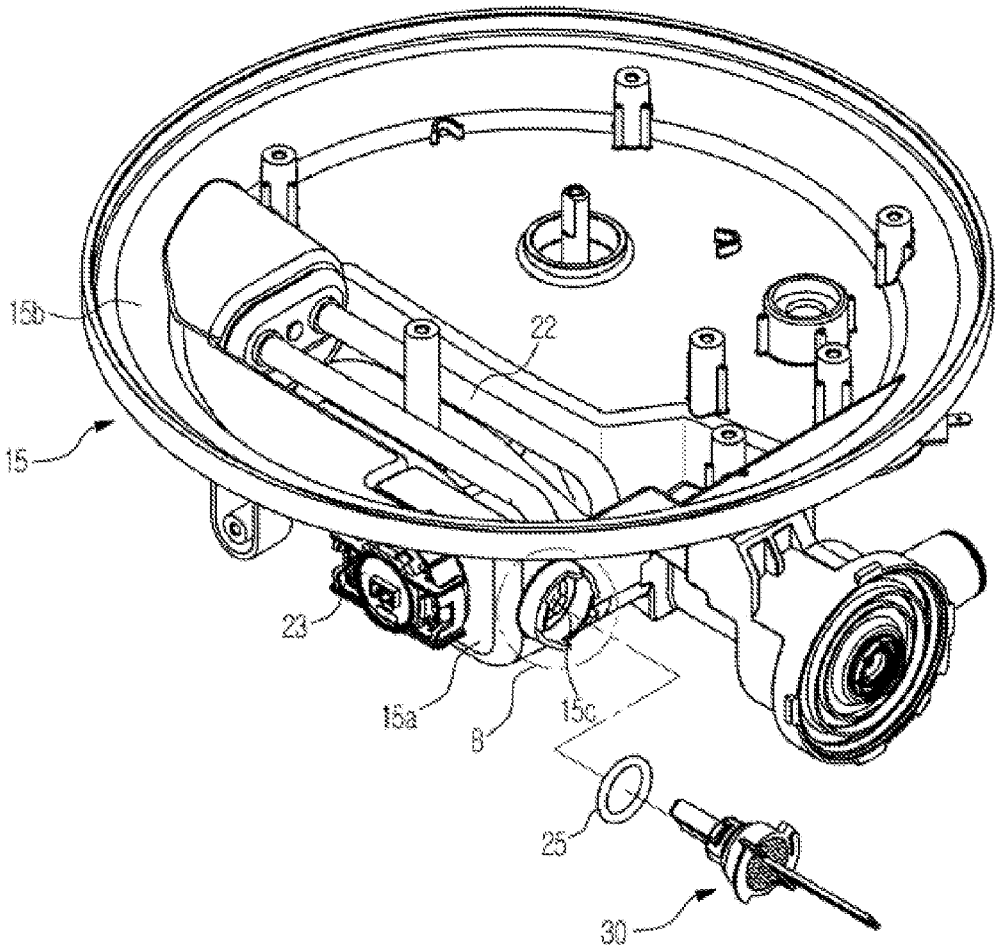
FIG. 2 is an exploded perspective view illustrating a sump of the dishwasher according to the embodiment of the present disclosure and a sensing module installed in the sump.
Figure 3:
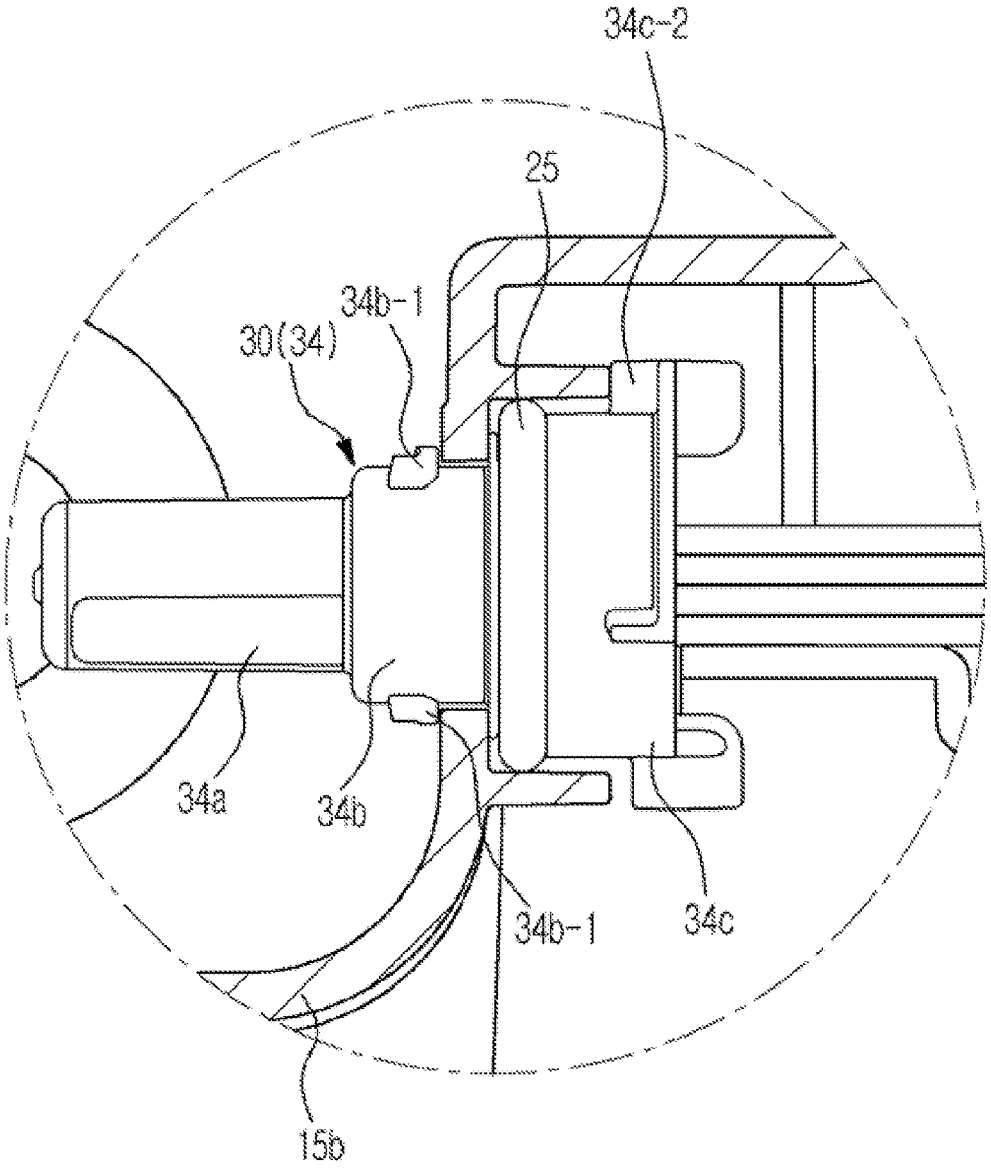
FIG. 3 is an enlarged view of portion A in FIG. 1.

Hereinafter, a dishwasher according to an embodiment of the present disclosure will be described in detail with reference to the drawings, wherein like reference numerals refer to like elements throughout.

As shown in FIG. 1, a dishwasher according to an embodiment of the present disclosure includes a main body 10 which defines an external appearance thereof and is provided, at a front surface thereof, with an insert hole 10*a* through which dishes are able to be loaded and unloaded, a washing tub 11 which is disposed inside the insert hole 10*a* and defines a washing chamber 11*a* to perform dishwashing, and a door 12 which is rotatably mounted, at a lower end thereof, to a lower portion of main body 10 to open and close the insert hole 10*a*.

The washing chamber 11*a* is provided therein with racks 13U and 13L to put dishes and nozzle units 14L, 14U, and 14M to spray water toward the dishes put on the racks 13U and 13L, and a lower portion of the washing chamber 11*a* is provided with a sump 15 to gather water used for washing.

The racks 13U and 13L are wire racks through which water sprayed from the nozzle units 14L, 14U, and 14M passes while accommodating dishes, and the wire racks are made of wires. The racks 13U and 13L may be vertically arranged at upward and downward sides in the washing chamber 11*a*. In addition, the racks 13U and 13L may be installed in the washing chamber 11*a* so as to be movable in a forward and backward direction, so that the racks 13U and 13L are withdrawn through the insert hole 10*a* from the washing chamber 11*a* while advancing or are inserted through the insert hole 10*a* into the washing chamber 11*a*. Accordingly, the dishes may be put on or taken out of the racks 13U and 13L in a state of withdrawing the racks 13U and 13L from the washing chamber 11*a*.

The nozzle units 14L, 14U, and 14M include a plurality of nozzles to spray water toward the dishes put on the racks 13U and 13L. In this embodiment, the nozzle units 14L, 14U, and 14M include a lower nozzle unit 14L disposed below the rack 13L arranged at the downward side, an upper nozzle unit 14U disposed above the rack 13U arranged at upward side, and an intermediate nozzle unit 14M disposed between the two racks 13U and 13L. The respective nozzle units 14L, 14U, and 14M are rotatably installed, and spray water toward the dishes put on the two racks 13U and 13L while rotating.

A water supply tube 16 to guide water from an external source (not shown) to the washing chamber 11*a* is connected to the rear side of the washing tub 11, and the water supply tube 16 is provided with a water supply valve 17 to selectively open and close the water supply tube 16.

The sump 15 serves to gather water supplied through the water supply tube 16 into the washing chamber 11*a* or water sprayed from the nozzle units 14L, 14U, and 14M. The sump 15 includes a water collecting portion 15*a* recessed downward to gather water, and a guide portion 15*b* connected to the lower portion of the washing tub 11 to guide water to the water collecting portion 15*a*.

The water collecting portion 15*a* is provided with a circulation pump 18 which transfers water gathered in the water collecting portion 15*a* to the nozzle units 14L, 14U, and 14M to circulate the water, and a drain pump 19 to discharge the water gathered in the water collecting portion 15*a* to the outside. The drain pump 19 is connected with a drain tube 21 to guide water from the drain pump 19 to the outside, and the circulation pump 18 is connected with a circulation tube 20 to guide water to the nozzle units 14L, 14U, and 14M.

In addition, the water collecting portion 15*a* is provided therein with a heater 22 to heat water and a variety of sensors.

As shown in FIGS. 2 to 6, the sensors installed to the water collecting portion 15*a* may include a turbidity sensor 23 to identify turbidity of water accommodated in the water collecting portion 15*a*, a water sensing sensor 31 to identify whether or not water is filled to a certain water level or more in the water collecting portion 15*a*, and a temperature sensor 32 to sense a temperature of water accommodated in the water collecting portion 15*a*.

According to one embodiment, the water sensing sensor 31 and the temperature sensor 32 may be incorporated into one sensing module 30 and installed to the water collecting portion 15*a*. Accordingly, in a case in which the water sensing sensor 31 and the temperature sensor 32 are incorporated into the sensing module 30, since, depending on installation of the sensing module 30 to the water collecting portion 15*a*, the water sensing sensor 31 and the temperature sensor 32 are simultaneously installed to the water collecting portion 15*a* without each individual installation of the water sensing sensor 31 and the temperature sensor 32, it may be possible to easily install the water sensing sensor 31 and the temperature sensor 32 and to efficiently utilize an inner space of the limited water collecting portion 15*a*.

Figure 4:
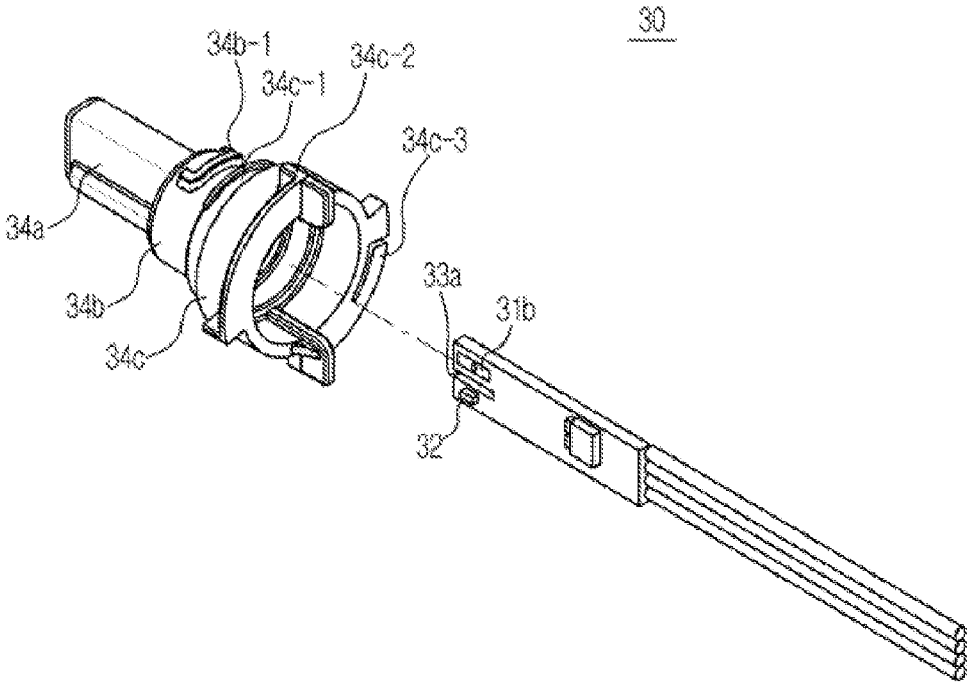
FIG. 4 is an exploded perspective view illustrating the sensing module applied to the dishwasher according to the embodiment of the present disclosure.

As shown in FIG. 4, the sensing module 30 includes one printed circuit board 33 on which the water sensing sensor 31 and the temperature sensor 32 are mounted, a sensor housing 34 accommodating the printed circuit board 33 on which the water sensing sensor 31 and the temperature sensor 32 are mounted, and a sealing member 25 which is installed to the sensor housing 34 to prevent leakage of water from between the sensor housing 34 and a seating portion 15*e*, to be described later, together with the above-mentioned water sensing sensor 31 and the temperature sensor 32. By accommodating the printed circuit board 33 in a space within the sensor housing 34 and then injecting and condensing a molten resin, the printed circuit board 33 is fixed in the sensor housing 34 while a space between an inner surface of the sensor housing 34 and the printed circuit board 33 is filled with the resin.

Figure 5:
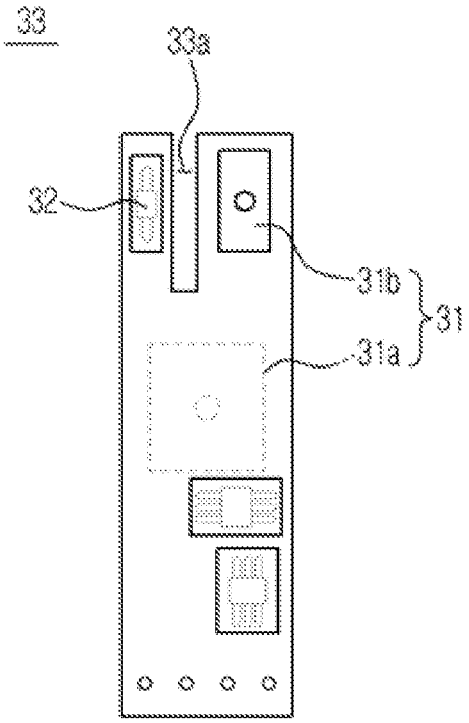
FIGS. 5 and 6 are views a form in which a water sensing sensor and a temperature sensor applied to the dishwasher according to the embodiment of the present disclosure are mounted on a printed circuit board.
Figure 6:
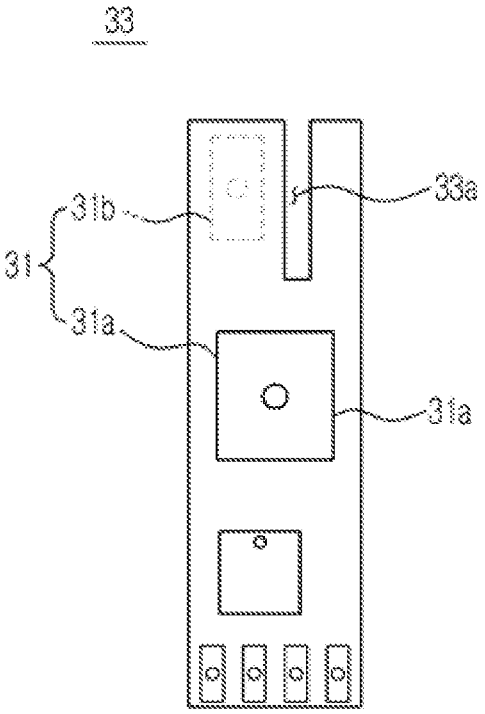

The printed circuit board 33 may be configured of a double-sided printed circuit board on both sides of which circuit patterns are formed. As shown in FIGS. 5 and 6, the water sensing sensor 31 is configured of a capacitive sensor which includes a first electrode 31*a* disposed on a first surface of the printed circuit board 33 and a second electrode 31*b* disposed on a second surface of the printed circuit board 33 opposite to the first surface. Each of the first and second electrodes 31*a* and 31*b* may be formed in a metal plate shape, the first electrode 31*a* may be disposed at a central side on the first surface of the printed circuit board 33, and the second electrode 31*b* and the temperature sensor 32 may be disposed side by side at one end side on the second surface of the printed circuit board 33.

The other end side of the printed circuit board 33 may be provided with connection portions 33*b*, and wires for signal transmission and power supply are connected to the connection portions 33*b*. In addition, the printed circuit board 33 may be provided with a slit 33*a* partitioning between the second electrode 31*b* and the temperature sensor 32, it may be possible to prevent operations of the second electrode 31*b* and the temperature sensor 32 from interfering with each other.

The above-mentioned capacitive sensor is a sensor to sense a change in capacitance depending on a change in dielectric constant between the two electrodes spaced apart from each other. When the water sensing sensor 31 configured of a capacitive sensor is incorporated into the sensing module 30 and then the sensing module 30 is installed to the water collecting portion 15*a*, a dielectric substance between the first electrode 31*a* and the second electrode 31*b* is changed depending on a level of water filled in the water collecting portion 15*a*, and thus capacitance between the first electrode 31*a* and the second electrode 31*b* is changed. Accordingly, it may be possible to identify whether or not water is filled to a certain water level or more in the water collecting portion 15*a* through such a change in capacitance.

As described above, when both the water sensing sensor 31 and the temperature sensor 32 are mounted on one printed circuit board 33 and signal transmission and reception and power supply in the water sensing sensor 31 and the temperature sensor 32 are performed through one printed circuit board 33, an installation structure and a connection structure of the water sensing sensor 31 and the temperature sensor 32 are simplified, thereby enabling the sensing module 30 to be configured more compactly.

Figure 7:
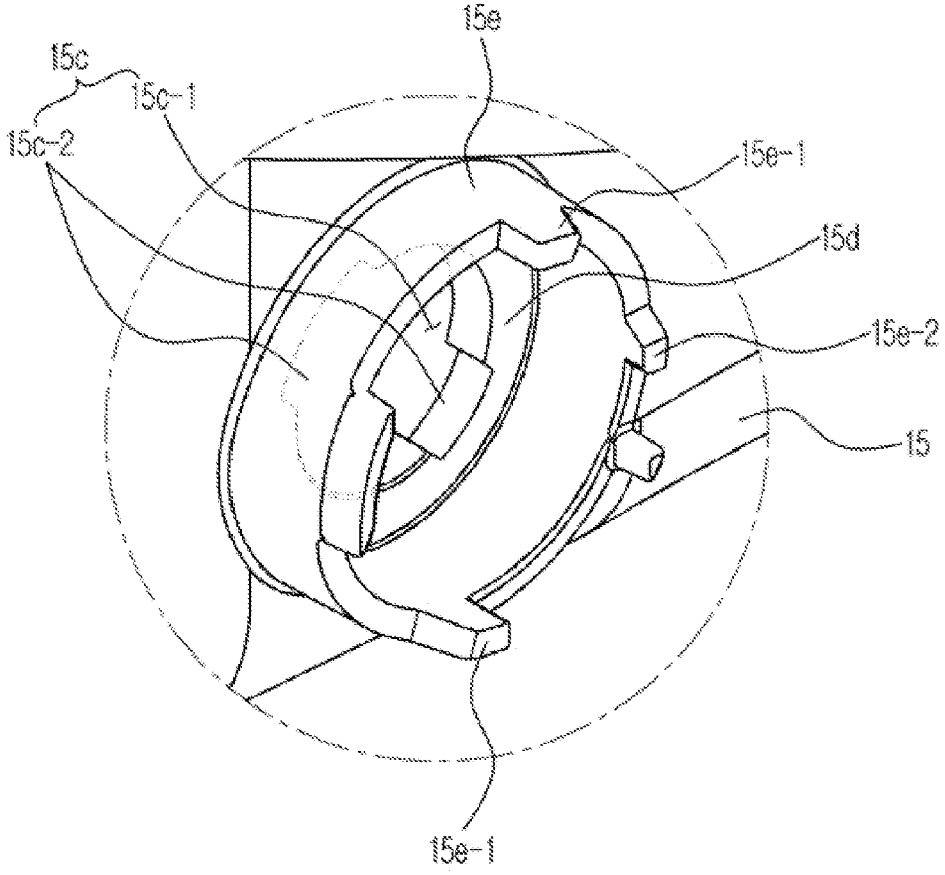
FIG. 7 is an enlarged view of portion B in FIG. 2.

As shown in FIG. 7, the water collecting portion 15*a* is provided with a through hole 15*c* arranged to install the sensing module 30, and a seating portion 15*e* extending from a part adjacent to the through hole 15*c* to the outside so as to seat a mounting portion 34*c* of the sensor housing 34, to be described later. In addition, the part adjacent to the through hole 15*c* is formed with a catching jaw 15*d* protruding inward of the seating portion 15*e* to catch and support the mounting portion 34*c*.

Figure 8:
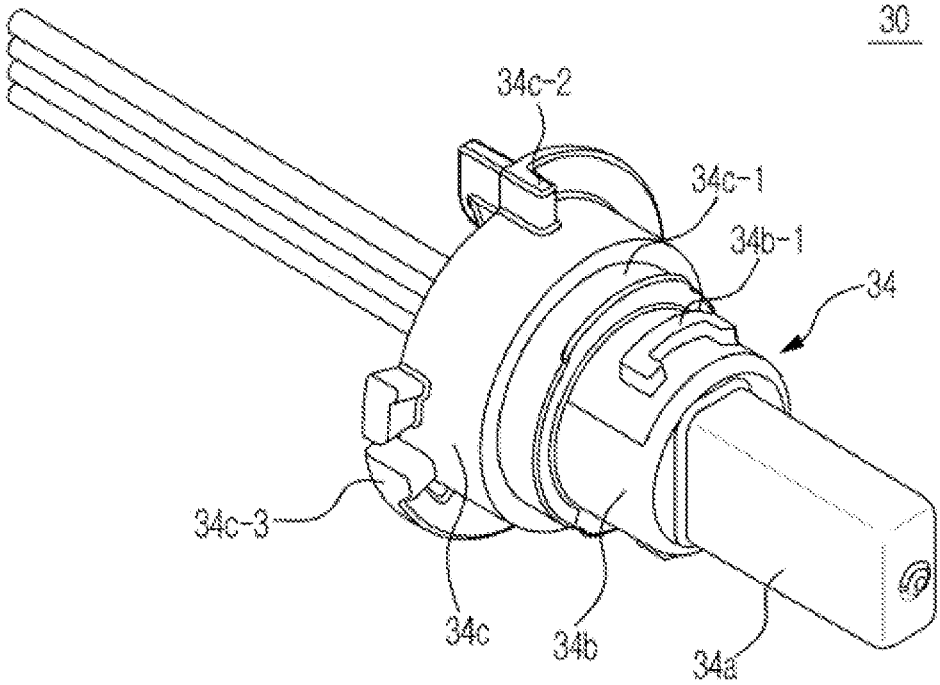
FIG. 8 is a perspective view illustrating the sensing module applied to the dishwasher according to the embodiment of the present disclosure.

As shown in FIG. 8, the sensor housing 34 may integrally include a sensing portion 34*a* which protrudes inward of the water collecting portion through the through hole 15*c* to come into contact with water filled in the water collecting portion 15*e*, a through portion 34*b* which may be formed to have a circular cross-section and rests on an inner surface of the through hole 15*c*, and a mounting portion 34*c* seated to the above-mentioned seating portion 15*e* to maintain a state in which the sensing module 30 is installed to the water collecting portion 15*a*.

The sensing portion 34*a* accommodates therein one end of the printed circuit board 33 on which the water sensing sensor 31 and the temperature sensor 32 are mounted, and thus senses whether or not water is present and the temperature of water.

The through portion 34*b* may include a catching portion 34*b*-1 protruding from an outer peripheral surface thereof. The catching portion 34*b*-1 passes through the through hole 15*c*, and then rests on a part adjacent to the through hole 15*c* of the water collecting portion 15*a* depending on rotation of the sensing module 30, thereby maintaining a state in which the through portion 34*b* is installed to the through hole 15*c*. In this embodiment, the catching portion 34*b*-1 includes two catching portions 34*b*-1 which are spaced apart from each other in a circumferential direction, and the two catching portions 34*b*-1 are formed to have different lengths from each other in the circumferential direction.

Meanwhile, the through hole 15*c* provided in the water collecting portion 15*a* includes a sensing portion passing part 15*c*-1 through which the sensing portion 34*a* passes, and catching portion passing parts 15*c*-2 arranged in shapes corresponding to the catching portions 34*b*-1 at both sides of the sensing portion passing part 15*c*-1. Accordingly, the two catching portions 34*b*-1 may pass through the two catching portion passing parts 15*c*-2 only when the sensing module 30 is installed to the through hole 15*c* at a certain angle.

The mounting portion 34*c* is formed to have a larger diameter than the through hole 15*c* so as to be caught and supported by the above-mentioned catching jaw 15*d*, and includes a sealing member installation portion 34*c*-1 to which the sealing member 25 is installed.

In addition, the seating portion 15*e* is provided with stopper portions 15*e*-1 protruding to limit a rotation angle of the sensing module 30 rotating as described above, and the mounting portion 34*c* is provided with stopper protrusions 34*c*-2 corresponding to the stopper portions 15*e*-1. Consequently, when the sensing module 30 rotates, the two stopper protrusions 34*c*-2 are caught by the two stopper portions 15*e*-1 such that the rotation angle of the sensing module 30 is limited to a certain degree or less. In this embodiment, the two stopper portions 15*e*-1 are formed at the seating portion 15*e* to be spaced in the circumferential direction, and the two stopper protrusions 34*c*-2 are formed at the mounting portion 34*c* to be spaced in the circumferential direction such that the two stopper protrusions 34*c*-2 correspond to the two stopper portions 15*e*-1.

In addition, the seating portion 15*e* is formed, at a fore end thereof, with a locking portion 15*e*-2 protruding in order for the sensing module 30 rotating in one direction to limit rotation in a reverse direction. The mounting portion 34*c* of the sensor housing 34 is provided with an elastic hook 34*c*-3 arranged to correspond to the locking portion 15*e*-2, and the elastic hook 34*c*-3 is elastically deformed depending on the rotation of the sensing module 30 and is caught by the locking portion 15*e*-2.

The sealing member 25 is formed of an O-ring made of an elastically deformable material, and is installed to the above-mentioned sealing member installation portion 34*c*-1. Accordingly, when the sensing module 30 is installed to the water collecting portion 15*a* and the mounting portion 34*c* is inserted into the seating portion 15*e* after the sealing member 25 is installed to the sealing member installation portion 34*c*-1 of the mounting portion 34*c*, a gap between the outer peripheral surface of the mounting portion 34*c* and the inner peripheral surface of the seating portion 15*e* is sealed by the sealing member 25. Therefore, leakage of water from the through hole 15*c* is prevented.

A process of installing the sensing module 30 having the above-mentioned structure to the water collecting portion 15*a* is as follows.

Figure 9:
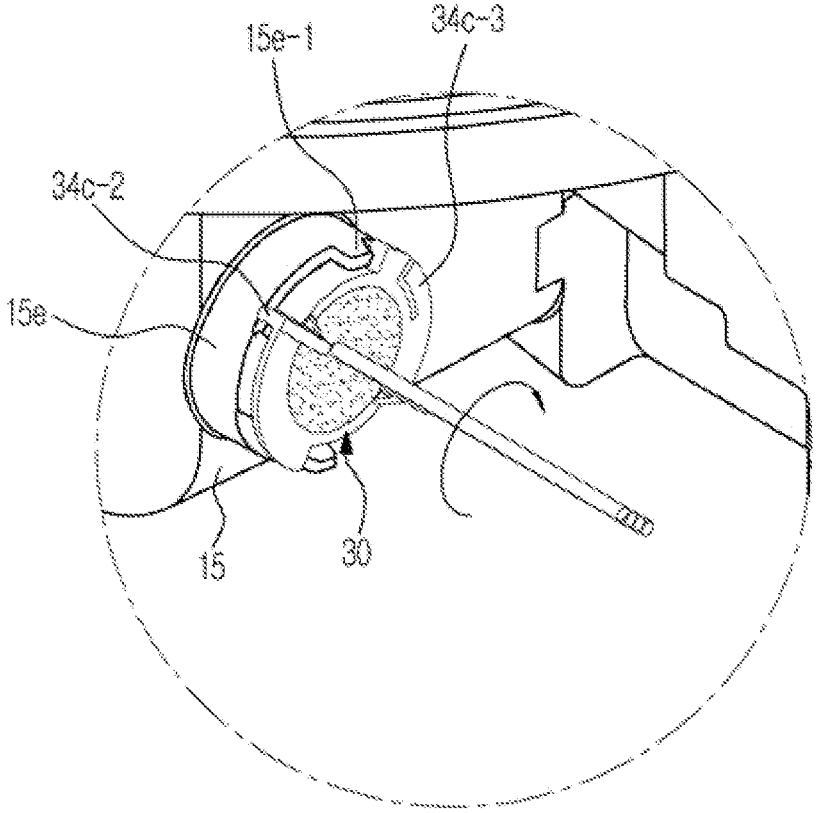
FIGS. 9 and 10 are perspective views illustrating a process by which the sensing module is installed in the sump in the dishwasher according to the embodiment of the present disclosure.

First, when the sensing module 30 is inserted into the through hole 15*c* at a certain angle such that the two catching portions 34*b*-1 may pass through the two catching passing parts 15*c*-2, the two catching portions 34*b*-1 pass through the two corresponding catching passing parts 15*c*-2, respectively, and the mounting portion 34*c* enters inside the seating portion 15*e* to be caught by the catching jaw 15*d*, as shown in FIG. 9.

Figure 10:
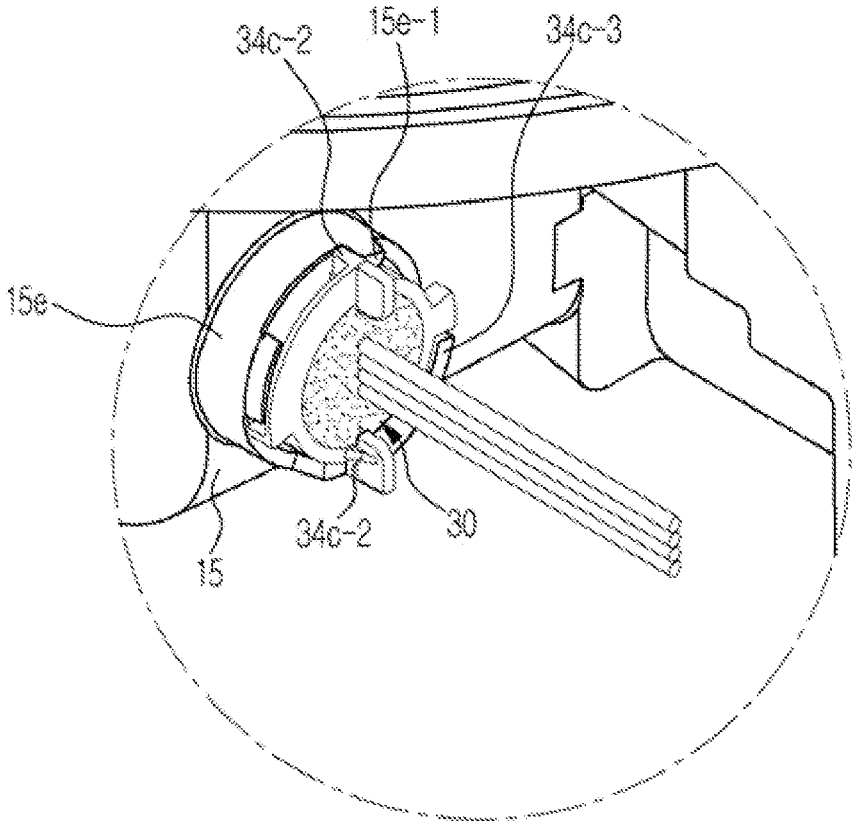

In this state, when the sensing module 30 rotates in one direction as shown in FIG. 10, the two catching portion 34*b*-1 rest on the inner surface of the water collecting portion 15*a* adjacent to the through hole 15*c*. In addition, since the stopper protrusions 34*c*-2 provided in the sensor housing 34 are caught by the stopper portions 15*e*-1 provided in the water collecting portion 15*a* during the rotation of the sensing module 30, the rotation of the sensing module 30 is limited and the sensing module 30 rotates only by a preset angle.

In addition, when the sensing module 30 rotates in one direction, the elastic hook 34*c*-3 is temporarily elastically deformed and is then returned to an original position to be thereby caught by the locking portion 15*e*-1. Therefore, the sensing module 30 is prevented from rotating in a reverse direction until a certain force or more is applied to the sensing module 30.

The two catching portions 34*b*-1 and the two catching portion passing parts 15*c*-2 are formed to have different lengths from each other in the circumferential direction, but the present disclosure is not limited thereto. For example, the two catching portions 34*b*-1 may be formed to have different shapes from each other, and the two catching portion passing parts 15*c*-2 may be formed to have respective shapes corresponding to the two catching portions 34*b*-1, whereby the sensing module 30 may also be installed to the water collecting portion 15*a* at a certain angle.

Hereinafter, an operation of the dishwasher according to the present disclosure having the above-mentioned configuration will be described.

When the dishwasher is operated after dishes are put on the racks 13U and 13L within the washing tub 11, water is supplied from the external source through the water supply tube 16 into the washing chamber 11*a*, and the supplied water is gathered in the water collecting portion 15*a* provided at the lower portion of the washing chamber 11*a*.

When water is filled to a certain water level or more in the water collecting portion 15*a*, the water sensing sensor 31 incorporated into the sensing module 30 senses whether or not water is present around the sensing module 30. When presence of water is sensed, the circulation pump 18 is operated. Water gathered in the water collecting portion 15*a* according to the operation of the circulation pump 18 is transferred to the nozzle units 14L, 14U, and 14M, and water transferred to the nozzle units 14L, 14U, and 14M is sprayed onto the dished put on the racks 13U and 13L through the nozzles to wash contaminants off of the dishes.

The operation of the circulation pump 18 is stopped after the dishwashing is completed, and the drain pump 19 is operated to discharge water gathered in the water collecting portion 15 through the drain tube 21 to the outside. When water in the water collecting portion 15 is lowered to a certain water level or less, the water sensing sensor 31 incorporated into the sensing module 30 senses whether or not water is present around the sensing module 30. When presence of water is not sensed, the operation of the circulation pump 19 is stopped and the dishwashing is completed.

In this embodiment, the sensing module 30 having the above-mentioned configuration is disposed to be spaced apart from the bottom of the sump 15 by a certain distance. Accordingly, water is sensed by the water sensing sensor 31 arranged in the sensing module 30 only in a state in which the water is filled to a certain water level or more within the sump 15. This serves to prevent the following issue. Water in the sump 15 is difficult to be perfectly discharged under the structure of the dishwasher, and thus residual water may be unavoidably present in the lower portion of the sump 15. Therefore, it may be misidentified that water is filled in the sump when the above residual water is sensed by the sensing module 30. Accordingly, such an issue is prevented by the above-mentioned structure.

Although the water sensing sensor 31 is configured of a capacitive sensor in this embodiment, the present disclosure is not limited thereto. For example, the sensing module 30 may employ any other type of proximity sensor together with the temperature sensor 32 so as to be operated as the water sensing sensor 31 and the temperature sensor 32.

Although all of the water sensing sensor 31 and the temperature sensor 32 are mounted on the printed circuit board 33 and the sensing module 30 simultaneously serves as the water sensing sensor 31 and the temperature sensor 32, the present disclosure is not limited thereto. For example, even when a sensing module 30 operated only as the water sensing sensor 31 without having a configuration corresponding to the temperature sensor 32 is applied to the present disclosure, the sensing module 30 may have a more compact size by arranging the first electrode 31*a* and the second electrode 31*b* at both sides of the printed circuit board 33.

As is apparent from the above description, since a water sensing sensor is realized by a capacitive sensor having a first electrode and a second electrode arranged on both sides of a printed circuit board in a sensing module applied to a dishwasher, the size of the water sensing sensor may be reduced and thus the sensing module may have a compact size.

In addition, one sensing module is installed to a sump and may sense whether or not water is present and the temperature of water, so that an inner space of the sump may be efficiently utilized.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A dishwasher comprising:

a washing chamber to perform dishwashing;

a water collecting portion provided at a lower portion of the washing chamber to gather water used for washing; and a sensing module which is disposed in the water collecting portion including a circuit board having a slit and integrally comprises:

a water sensing sensor including a capacitive sensor mounted on the circuit board to sense whether or not water is present in the water collecting portion, and a temperature sensor to sense a temperature of water in the water collecting portion, the temperature sensor mounted on the circuit board and separated from an electrode of the capacitive sensor by the slit to prevent interference of an operation of the water sensing sensor with the temperature sensor, wherein the temperature sensor and the electrode of the capacitive sensor are mounted on an end portion of the circuit board, and the slit is arranged between the temperature sensor and the electrode of the capacitive sensor.

2. The dishwasher according to claim 1, wherein the sensing module is disposed to be spaced apart from a bottom of the water collecting portion.

3. The dishwasher according to claim 1, wherein:

the circuit board being a printed circuit board; and the capacitive sensor comprises a first electrode disposed on a first surface of the printed circuit board and a second electrode disposed on a second surface of the printed circuit board opposite to the first surface.

4. The dishwasher according to claim 3, wherein the second electrode of the capacitive sensor and the temperature sensor are disposed side by side at one end of the printed circuit board.

5. The dishwasher according to claim 4, wherein the second electrode of the capacitive sensor and the temperature sensor are separated by the slit.

6. The dishwasher according to claim 3, wherein the sensing module comprises a sensor housing accommodating the printed circuit board on which the water sensing sensor and the temperature sensor are mounted.

7. The dishwasher according to claim 6, wherein the sensing module further comprises a resin filled in an inner portion of the sensor housing to fill a space between the printed circuit board and the inner portion of the sensor housing.

8. The dishwasher according to claim 6, wherein:

the sensor housing comprises a sensing portion protruding inward of the water collecting portion, the printed circuit board being disposed within the sensing portion; and the water collecting portion comprises a through hole provided on a side wall thereof, the sensing portion protruding through the through hole.

9. The dishwasher according to claim 8, wherein:

the sensor housing comprises at least one catching portion protruding from an outer peripheral surface thereof; and the through hole comprises a sensing portion passing part through which the sensing portion passes, and at least one catching portion passing part formed in a shape corresponding to the at least one catching portion such that the at least one catching portion passes through the at least one catching portion passing part.

10. The dishwasher according to claim 9, wherein:

the at least one catching portion comprises two catching portions formed in different shapes from each other; and the at least one catching portion passing part comprises two catching portion passing parts formed in respective shapes corresponding to the two catching portions.

11. The dishwasher according to claim 9, wherein:

the water collecting portion comprises a pair of stopper portions to limit a rotation angle of the sensing module; and the sensor housing comprises a pair of stopper protrusions which are respectively caught by the pair of stopper portions depending on rotation of the sensing module.

12. The dishwasher according to claim 9, wherein:

the water collecting portion comprises a locking portion protruding in order for the sensing module rotating in one direction to limit rotation in a reverse direction; and the sensor housing comprises an elastic hook provided to correspond to the locking portion, the elastic hook being elastically deformed as the sensing module rotates in one direction and being caught by the locking portion.

13. The dishwasher according to claim 8, wherein:

the sensor housing comprises a mounting portion formed to have a larger diameter than the through hole; and the water collecting portion comprises a seating portion extending from a part adjacent to the through hole to seat and support the mounting portion.

14. The dishwasher according to claim 13, further comprising a sealing member to seal between an inner peripheral surface of the seating portion and an outer peripheral surface of the mounting portion.

15. A dishwasher comprising:

a washing chamber to perform dishwashing;

a water collecting portion provided at a lower portion of the washing chamber to gather water used for washing; and a sensing module disposed in the water collecting portion to sense whether or not water is present including:

a printed circuit board having a slit, and a water sensing sensor mounted on the printed circuit board including a capacitive sensor including a first electrode disposed on a first surface of the printed circuit board and a second electrode disposed on a second surface of the printed circuit board opposite to the first surface to sense whether or not water is present in the water collecting portion, and a temperature sensor to sense a temperature of water in the water collecting portion, the temperature sensor mounted on the printed circuit board and separated from at least one of the first electrode and the second electrode of the capacitive sensor by the slit to prevent interference of an operation of the water sensing sensor with the temperature sensor, wherein the temperature sensor and at least one of the first electrode and the second electrode of the capacitive sensor are mounted on an end portion of the printed circuit board, and the slit is arranged between the temperature sensor and the at least one of the first electrode and the second electrode of the capacitive sensor.

16. The dishwasher according to claim 15, wherein the second electrode and the temperature sensor are disposed side by side at one end of the printed circuit board.

17. The dishwasher according to claim 16, wherein the slit in the printed circuit board is between the second electrode of the capacitive sensor and the temperature sensor.

18. A sensing module for a dishwasher comprising:

a printed circuit board having a slit;

a capacitive sensor installed in a dishwasher including a water collecting portion, the capacitive sensor to sense whether or not water is present in the water collecting portion and including:

a first electrode disposed on a first surface of the printed circuit board, and a second electrode disposed on a second surface of the printed circuit board opposite to the first surface; and a temperature sensor disposed on the printed circuit board to sense a temperature of water in the water collecting portion and separated from at least one of the first electrode and the second electrode of the capacitive sensor by the slit to prevent interference of an operation of a water sensing sensor with the temperature sensor, wherein the temperature sensor and at least one of the first electrode and the second electrode of the capacitive sensor are mounted on an end portion of the printed circuit board, and the slit is arranged between the temperature sensor and the at least one of the first electrode and the second electrode of the capacitive sensor.

19. The sensing module for a dishwasher according to claim 18, wherein the second electrode and the temperature sensor are disposed side by side at one end of the printed circuit board.

20. The sensing module for a dishwasher according to claim 19, wherein the slit in the printed circuit board is between the second electrode of the capacitive sensor and the temperature sensor.

21. The sensing module for a dishwasher according to claim 18, further comprising a sensor housing to accommodate the printed circuit board.

* * * * *